US005087415A

United States Patent [19]

Hemphill et al.

[11] Patent Number: 5,087,415

[45] Date of Patent: Feb. 11, 1992

[54] HIGH STRENGTH, HIGH FRACTURE TOUGHNESS STRUCTURAL ALLOY

[75] Inventors: Raymond M. Hemphill, Wyomissing; David E. Wert, West Lawn, both of Pa.

[73] Assignee: Carpenter Technology Corporation, Reading, Pa.

[21] Appl. No.: 475,773

[22] Filed: Feb. 6, 1990

Related U.S. Application Data

[63] Continuation-in-part of Ser. No. 328,875, Mar. 27, 1989, abandoned.

[51] Int. Cl.[5] ..... C22C 38/52

[52] U.S. Cl. ..... 420/95; 420/107; 148/335

[58] Field of Search ..... 148/328, 335; 420/97, 420/96, 95, 107, 108

[56] References Cited

U.S. PATENT DOCUMENTS

| | | | |
|---|---|---|---|
| 3,502,462 | 3/1970 | Dabkowski et al. | 420/95 |
| 3,585,011 | 6/1971 | Matas et al. | 428/638 |
| 4,076,525 | 2/1978 | Little et al. | 420/95 |
| 4,152,148 | 5/1979 | Machmeier | 420/107 |

FOREIGN PATENT DOCUMENTS 2008423 5/1969 France .

1159969 11/1966 United Kingdom .

OTHER PUBLICATIONS

Key to Steels, 10 Edition 1974, W. Germany.

*Primary Examiner*—Deborah Yee

*Attorney, Agent, or Firm*—Dann, Dorfman, Herrell and Skillman

[57] ABSTRACT

A high strength, high fracture toughness structural steel alloy consisting essentially of, in weight percent, about

| | |
|---|---|
| C | 0.2–0.33 |
| Cr | 2–4 |
| Ni | 10.5–15 |
| Mo | 0.75–1.75 |
| Co | 8–17 |
| Fe | Balance |

and an article made therefrom are disclosed. The alloy is an age-hardenable martensitic steel alloy whcih provides a unique combination of tensile strength and fracture toughness. The alloy provides excellent mechanical properties when hardened by vacuum heat treatment with inert gas cooling and has a low ductile-to-brittle transition temperature.

29 Claims, No Drawings

HIGH STRENGTH, HIGH FRACTURE TOUGHNESS STRUCTURAL ALLOY

This application is a continuation-in-part of application Ser. No. 07/328,875, filed on Mar. 27, 1989 now abandoned and assigned to the assignee of the present application.

BACKGROUND OF THE INVENTION

This invention relates to an age-hardenable, martensitic steel alloy, and in particular to such an alloy and an article made therefrom in which the elements are closely controlled to provide a unique combination of high tensile strength, high fracture toughness and good resistance to stress corrosion cracking in a marine environment.

Heretofore, an alloy designated as 300M has been used in structural components requiring high strength and light weight. The 300M alloy has the following composition in weight percent:

| | wt. % |
|---|---|
| C | 0.40–0.46 |
| Mn | 0.65–0.90 |
| Si | 1.45–1.80 |
| Cr | 0.70–0.95 |
| Ni | 1.65–2.00 |
| Mo | 0.30–0.45 |
| V | 0.05 min. |

the balance is essentially iron. The 300M alloy is capable of providing tensile strength in the range of 280–300 ksi.

A need has arisen for a high strength alloy such as 300M but having high fracture toughness as represented by a stress intensity factor, $K_{IC}$, $\geqq 100$ ksi $\sqrt{in}$. The fracture toughness provided by the 300M alloy, represented by a $K_{IC}$ of about 55–60 ksi in, is not sufficient to meet that requirement. Higher fracture toughness is desirable for better reliability in components and because it permits non-destructive inspection of a structural component for flaws that can result in catastrophic failure.

An alloy designated as AF1410 is known to provide good fracture toughness as represented by $K_{IC} \geqq 100$ ksi $\sqrt{in}$. The AF1410 alloy is described in U.S. Pat. No. 4,076,525 ('525) issued to Little et al. on Feb. 28, 1978. The AF1410 alloy has the following composition in weight percent, as set forth in the '525 patent:

| | wt. % |
|---|---|
| C | 0.12–0.17 |
| Cr | 1.8–3.2 |
| Ni | 9.5–10.5 |
| Mo | 0.9–1.35 |
| Co | 11.5–14.5 |

and the balance is essentially iron. The AF1410 alloy, however, leaves much to be desired with regard to tensile strength. It is capable of providing ultimate tensile strength up to 270 ksi, a level of strength not suitable for highly stressed structural components in which the very high strength to weight ratio provided by 300M is required. It would be very desirable to have an alloy which provides the good fracture toughness of the AF1410 alloy in addition to the high tensile strength provided by the 300M alloy.

SUMMARY OF THE INVENTION

Accordingly, it is a principal object of this invention to provide an age-hardenable, martensitic steel alloy and an article made therefrom which are characterized by a unique combination of high tensile strength and high fracture toughness.

More specifically, it is an object of this invention to provide such an alloy which is characterized by significantly higher tensile strength than provided by the AF1410 alloy while still maintaining high fracture toughness.

A further object of this invention is to provide an alloy which, in addition to high strength and high fracture toughness, is designed to provide high resistance to stress corrosion cracking in marine environments.

Another object of this invention is to provide a high strength alloy having a low ductile-to-brittle transition temperature.

The foregoing, as well as additional objects and advantages of the present invention, are achieved in an age-hardenable, martensitic steel alloy as summarized in Table I below, containing in weight percent, about:

TABLE I

| | Broad | Intermediate | Preferred |
|---|---|---|---|
| C | 0.2–0.33 | 0.20–0.31 | 0.21–0.27 |
| Cr | 2–4 | 2.25–3.5 | 2.5–3.3 |
| Ni | 10.5–15 | 10.75–13.5 | 11.0–12.0 |
| Mo | 0.75–1.75 | 0.75–1.5 | 1.0–1.3 |
| Co | 8–17 | 10–15 | 11–14 |
| Fe | Bal. | Bal. | Bal. |

The balance may include additional elements in amounts which do not detract from the desired combination of properties. Preferably, for example, about 0.2% max. manganese, about 0.1% max. silicon, about 0.01% max. each of titanium and aluminum, and a trace amount up to about 0.001% each of rare earth metals such a cerium and lanthanum can be present in this alloy. Preferably, not more than about 0.008% phosphorus and not more than about 0.004% sulfur are present in this alloy.

The foregoing tabulation is provided as a convenient summary and is not intended to restrict the lower and upper values of the ranges of the individual elements of the alloy of this invention for use solely in combination with each other, or to restrict the broad, intermediate or preferred ranges of the elements for use solely in combination with each other. Thus, one or more of the broad, intermediate, and preferred ranges can be used with one or more of the other ranges for the remaining elements. In addition, a broad, intermediate, or preferred minimum or maximum for an element can be used with the maximum or minimum for that element from one of the remaining ranges. Here and throughout this application percent (%) means percent by weight, unless otherwise indicated.

The alloy according to the present invention is critically balanced to provide a unique combination of high tensile strength, high fracture toughness, and stress corrosion cracking resistance. For example, when more than about 1.3% molybdenum is present in this alloy, the amount of carbon and/or cobalt are preferably adjusted downwardly so as to be within the lower half of their respective elemental ranges. Carbon and cobalt are preferably balanced in accordance with the following relationships:

a) %Co≦35-81.8(%C);

b) %Co≧25.5-70(%C); and, for best results c) %Co≧26.9-70(%C).

DETAILED DESCRIPTION

The alloy according to the present invention contains at least about 0.2%, better yet, at least about 0.20%, and preferably at least about 0.21% carbon because it contributes to the good hardness capability and high tensile strength of the alloy primarily by combining with other elements such as chromium and molybdenum to form carbides during heat treatment. Too much carbon adversely affects the fracture toughness of this alloy. Accordingly, carbon is limited to not more than about 0.33%, better yet, to not more than about 0.31%, and preferably to not more than about 0.27%.

Cobalt contributes to the hardness and strength of this alloy and benefits the ratio of yield strength to tensile strength (Y.S./U.T.S.). Therefore, at least about 8%, better yet at least about 10%, and preferably at least about 11% cobalt is present in this alloy. For best results at least about 12% cobalt is present. Above about 17% cobalt the fracture toughness and the ductile-to-brittle transition temperature of the alloy are adversely affected. Preferably, not more than about 15%, and better yet not more than about 14% cobalt is present in this alloy.

Cobalt and carbon are critically balanced in this alloy to provide the unique combination of high strength and high fracture toughness that is characteristic of the alloy. Thus, to ensure good fracture toughness, carbon and cobalt are preferably balanced in accordance with the following relationship:

a) %Co≦35-81.8(%C).

To ensure that the alloy provides the desired high strength and hardness, carbon and cobalt are preferably balanced such that:

b) %Co≧25.5-70(%C); and, for best results c) %Co≧26.9-70(%C).

Chromium contributes to the good hardenability and hardness capability of this alloy and benefits the desired low ductile-brittle transition temperature of the alloy. Therefore, at least about 2%, better yet at least about 2.25%, and preferably at least about 2.5% chromium is present. Above about 4% chromium the alloy is susceptible to rapid overaging such that the unique combination of high tensile strength and high fracture toughness is not attainable. Preferably, chromium is limited to not more than about 3.5%, and better yet to not more than about 3.3%. When the alloy contains more than about 3% chromium, the amount of carbon present in the alloy is adjusted upwardly in order to ensure that the alloy provides the desired high tensile strength.

At least about 0.75% and preferably at least about 1.0% molybdenum is present in this alloy because it benefits the desired low ductile brittle transition temperature of the alloy. Above about 1.75% molybdenum the fracture toughness of the alloy is adversely affected. Preferably, molybdenum is limited to not more than about 1.5%, and better yet to not more than about 1.3%. When more than about 1.3% molybdenum is present in this alloy the % carbon and/or % cobalt must be adjusted downwardly in order to ensure that the alloy provides the desired high fracture toughness. Accordingly, when the alloy contains more than about 1.3% molybdenum, the % carbon is not more than the median % carbon for a given % cobalt as defined by equations a) and b) or a) and c).

Nickel contributes to the hardenability of this alloy such that the alloy can be hardened with or without rapid quenching techniques. Nickel benefits the fracture toughness and stress corrosion cracking resistance provided by this alloy and contributes to the desired low ductile-to-brittle transition temperature. Accordingly, at least about 10.5%, better yet, at least about 10.75%, and preferably at least about 11.0% nickel is present. Above about 15% nickel the fracture toughness and impact toughness of the alloy can be adversely affected because the solubility of carbon in the alloy is reduced which may result in carbide precipitation in the grain boundaries when the alloy is cooled at a slow rate, such as when air cooled following forging. Preferably, nickel is limited to not more than about 13.5%, and better yet to not more than about 12.0%.

Other elements can be present in this alloy in amounts which do not detract from the desired properties. Preferably, for example, about 0.2% max., better yet about 0.10% max., and for best results about 0.05% max. manganese can be present. Up to about 0.1% silicon, up to about 0.01% aluminum, and up to about 0.01% titanium can be present as residuals from small additions for deoxidizing the alloy. A trace amount up to about 0.001% each of such rare earth metals as cerium and lanthanum can be present as residuals from small additions for controlling the shape of sulfide and oxide inclusions.

The balance of the alloy according to the present invention is essentially iron except for the usual impurities found in commercial grades of alloys intended for similar service or use. The levels of such elements must be controlled so as not to adversely affect the desired properties of this alloy. For example, phosphorus is limited to not more than about 0.008% and sulfur is limited to not more than about 0.004%. Tramp elements such as lead, tin, arsenic and antimony are limited to about 0.003% max. each, and preferably to about 0.002% max. each. Oxygen is limited to not more than about 20 parts per million (ppm) and nitrogen to not more than about 40 ppm.

The alloy of the present invention is readily melted using conventional vacuum melting techniques. For best results, as when additional refining is desired, a multiple melting practice is preferred. The preferred practice is to melt a heat in a vacuum induction furnace (VIM) and cast the heat in the form of an electrode. The electrode is then remelted in a vacuum arc furnace (VAR) and recast into one or more ingots. Prior to VAR the electrode ingots are preferably stress relieved at about 1,250° F. for 4-16 hours and air cooled. After VAR the ingot is preferably homogenized at about 2,150° F. for 6-10 hours.

The alloy can be hot worked from about 2,150° F. to about 1,500° F. The preferred hot working practice is to forge an ingot from about 2,150° F. to obtain at least a 30% reduction in cross sectional area. The ingot is then reheated to about 1,800° F. and further forged to obtain at least another 30% reduction in cross sectional area.

The alloy according to the present invention is austenitized and age hardened as follows. Austenitizing of the alloy is carried out by heating the alloy at about 1,550°-1,650° F. for about 1 hour plus about 5 minutes per inch of thickness and then quenching in oil. The hardenability of this alloy is good enough to permit air cooling or vacuum heat treatment with inert gas quenching, both of which have a slower cooling rate than oil quenching. When this alloy is to be oil quenched, however, it is preferably austenitized at about 1,550°-1,600° F., whereas when the alloy is to be vacuum treated or air hardened it is preferably austenitized at about 1,575°-1,650° F. After austenitizing, the alloy is preferably cold treated as by deep chilling at about −100° F. for ½ to 1 hour and then warmed in air.

Age hardening of this alloy is preferably conducted by heating the alloy at about 850°-925° F. for about 5 hours followed by cooling in air. When austenitized and age hardened the alloy according to the present invention provides an ultimate tensile strength of at least about 280 ksi and longitudinal fracture toughness of at least 100 ksi $\sqrt{in}$. Furthermore, the alloy can be aged within the foregoing process parameters to provide a Rockwell hardness of at least 54 HRC when it is desired for use in ballistically tolerant articles.

EXAMPLE

As an example of the alloy according to the present invention, a 400 lb VIM heat having the composition in weight percent shown in Table II was prepared and cast into a 6⅛ in round ingot.

TABLE II

| | wt. % |
|---|---|
| Carbon | 0.22 |
| Manganese | <0.01 |
| Silicon | <0.01 |
| Phosphorus | <0.005 |
| Sulfur | 0.002 |
| Chromium | 3.03 |
| Nickel | 11.17 |
| Molybdenum | 1.18 |
| Cobalt | 13.89 |
| Cerium | <0.001 |
| Lanthanum | <0.001 |
| Titanium | <0.01 |
| Iron* | Balance |

*Iron charge material was a standard grade of electrolytic iron.

The ingot was vermiculite cooled, stress relieved at 1,250° F. for 4 h, and then air cooled. The ingot was remelted by VAR, cast as an 8 in round ingot, and then vermiculite cooled. The remelted ingot was stress relieved at 1,250° F. for 4 h and cooled in air.

Prior to forging, the ingot was homogenized at 2,150 F. for 16 h. The ingot was then forged from the temperature of 2,150° F. to 3½ in high by 5 in wide bar. The bar was cut into 4 sections which were reheated to 1,800° F., forged to 1½ inch×3⅜ inch bars, and then cooled in air.

The forged bars were annealed at 1,250° F. for 16 h and then air cooled. A transverse tensile specimen (0.252 inch diameter by 2 in long) was machined from one of the annealed bars. The tensile specimen was austenitized in salt for 1 h at 1,550° F., oil quenched, deep chilled at −100° F. for 1 h, and then warmed in air. The specimen was then age hardened for 5 h at 875° F. and air cooled. The results of room temperature tensile tests on the transverse specimen are shown in Table III including the 0.2% offset yield strength (0.2% Y.S.) and the ultimate tensile strength (U.T.S.) in ksi, as well as the percent elongation (% El.) and percent reduction in are a (% R.A.). The hardness of the specimen was measured and is given in Table III as Rockwell C scale hardness (HRC).

TABLE III

| 0.2% Y.S. (ksi) | U.T.S. (ksi) | % El. | % R.A. | HRC |
|---|---|---|---|---|
| 261.9 | 285.2 | 12.2 | 59.3 | 53.0 |

A standard compact tension fracture toughness specimen was machined with a longitudinal orientation from one of the remaining annealed bars. The fracture toughness specimen was austenitized, deep chilled, and age hardened in the same manner as the tensile specimen. The results of room temperature fracture toughness testing in accordance with ASTM Standard Test E399 is shown in Table IV as $K_{IC}$ in ksi $\sqrt{in}$. The hardness of the specimen was measured and is given as HRC.

TABLE IV

| $K_{IC}$ (ksi $\sqrt{in}$) | HRC |
|---|---|
| 105.1 | 53.0 |

The data of Tables III and IV clearly show that the alloy according to the present invention provides an ultimate tensile strength in excess of 280 ksi in combination with high fracture toughness as represented by a $K_{IC}$ in excess of 100 ksi $\sqrt{in}$.

Standard Charpy V-notch impact test specimens were machined with a transverse orientation from other of the annealed bars. Duplicate sets of the impact toughness specimens were austenitized and quenched as shown in Table V. The specimens were then deep chilled at −100° F. for 1 h. Duplicate test specimens were aged for 5 h at the temperatures shown in Table V. The results of room temperature and −65° F. Charpy V-notch impact tests (CVN) are reported in Table V in ft-lbs. The average hardness for each test set of duplicate specimens is also given in Table V as Rockwell C-scale hardness (HRC).

TABLE V

| Aust. Temp(F.) | Quench | Age Temp(F.) | Test Temp(F.) | CVN (ft-lbs) | HRC |
|---|---|---|---|---|---|
| 1575 | O.Q. | 850 | R.T. | 20,20 | 54.0 |
| | | 875 | | 26,25 | 53.5 |
| | | 900 | | 25,31 | 52.0 |
| | | 925 | | 40,35 | 49.0 |
| | | 850 | −65 | 19,19 | 54.5 |
| | | 875 | | 24,23 | 53.5 |
| | | 900 | | 21,23 | 52.0 |
| | | 925 | | 30,27 | 49.5 |
| 1600 | V.C. | 850 | R.T. | 24,24 | 54.5 |
| | | 875 | | 26,25 | 54.0 |
| | | 900 | | 30,29 | 52.5 |
| | | 925 | | 41,37 | 50.0 |
| | | 850 | −65 | 26,24 | 55.0 |
| | | 875 | | 28,23 | 54.5 |
| | | 900 | | 27,24 | 53.0 |
| | | 925 | | 30,25 | 50.5 |

The data of Table V shows that the alloy according to the present invention retains substantial toughness at a very low temperature which is indicative of the low ductile-to-brittle transition temperature of this alloy. The Table V data further shows the excellent strength and toughness provided by this alloy when subjected to the slower quenching rate of vermiculite cooling and therefore, the alloys' suitability for vacuum heat treatment with inert gas quenching.

The alloy according to the present invention is useful in a variety of applications requiring high strength and low weight, for example, aircraft landing gear components; aircraft structural members, such as braces, beams, struts, etc.; helicopter rotor shafts and masts; and other aircraft structural components which are subject to high stress in service. The alloy of the present invention could be suitable for us in jet engine shafts. This alloy can also be aged to very high hardness which makes it suitable for use as lightweight armor and in structural components which must be ballistically tolerant. The present alloy is, of course, suitable for use in a variety of product forms including billets, bars, tubes, plate and sheet.

It is apparent from the foregoing description and the accompanying examples, that the alloy according to the present invention provides a unique combination of tensile strength and fracture toughness not provided by known alloys. This alloy is well suited to applications where high strength and low weight are required. The present alloy has a low ductile-to-brittle transition which renders it highly useful in applications where the in-service temperatures are well below zero degrees Fahrenheit. Because this alloy can be vacuum heat treated, it is particularly advantageous for use in the manufacture of complex, close tolerance components. Vacuum heat treatment of such articles is desirable because the articles do not undergo any distortion as usually results from oil quenching of such articles made from known alloys.

The terms and expressions which have been employed herein are used as terms of description and not of limitation. There is no intention in the use of such terms and expressions to exclude any equivalents of the features described or any portions thereof. It is recognized, however, that various modifications are possible within the scope of the invention claimed.

What is claimed is:

1. An age hardenable, martensitic steel alloy which provides high strength and high fracture toughness, said alloy consisting essentially of, in weight percent, about

| | wt. % |
|---|---|
| Carbon | 0.2–0.33 |
| Chromium | 2–4 |
| Nickel | 10.5–15 |
| Molybdenum | 0.75–1.75 |
| Cobalt | 8–17 |

and the balance is essentially iron.

2. An alloy as set forth in claim 1 containing at least about 0.21% carbon.

3. An alloy as set forth in claim 1 containing at least about 10.75% nickel.

4. An alloy as set forth in claim 1 wherein a) $\%Co \leqq 35-81.8(\%C)$.

5. An alloy as set forth in claim 4 wherein b) $\%Co \geqq 25.5-70(\%C)$.

6. An alloy as set forth in claim 5 wherein when $\%Mo > 1.3$, %C is not more than the median %C for a given %Co as defined by relationships a) and b).

7. An alloy as set forth in claim 4 wherein c) $\%Co \geqq 26.9-70(\%C)$.

8. An alloy as set forth in claim 7 wherein when $\%Mo > 1.3$, %C is not more than the median %C for a given %Co as defined by relationships a) and c).

9. An alloy as set forth in claim 1 containing about 0.05% max. manganese.

10. An age-hardenable, martensitic steel alloy which provides high strength and high fracture toughness, said alloy consisting essentially of, in weight percent, about

| | wt. % |
|---|---|
| Carbon | 0.20–0.31 |
| Chromium | 2.25–3.5 |
| Nickel | 10.75–13.5 |
| Molybdenum | 0.75–1.5 |
| Cobalt | 10–15 |

and the balance is essentially iron.

11. An alloy as set forth in claim 10 containing at least about 0.21% carbon.

12. An alloy as set forth in claim 10 containing at least about 11.0% nickel.

13. An alloy as set forth in claim 10 wherein a) $\%Co \leqq 35-81.8(\%C)$.

14. An alloy as set forth in claim 13 wherein b) $\%Co \geqq 25.5-70(\%C)$.

15. An alloy as set forth in claim 14 wherein when $\%Mo > 1.3$, %C is not more than the median %C for a given %Co as defined by relationships a) and b).

16. An alloy as set forth in claim 10 containing about 0.05% max. manganese.

17. An age-hardenable, martensitic steel alloy which provides high strength and high fracture toughness, said alloy consisting essentially of, in weight percent, about

| | wt. % |
|---|---|
| Carbon | 0.21–0.27 |
| Chromium | 2.5–3.3 |
| Nickel | 11.0–12.0 |
| Molybdenum | 1.0–1.3 |
| Cobalt | 11–14 |

and the balance is essentially iron.

18. An alloy as set forth in claim 17 wherein a) $\%Co \leqq 35-81.8(\%C)$.

19. An alloy as set forth in claim 18 wherein b) $\%Co \geqq 25.5-70(\%C)$.

20. An alloy as set forth in claim 17 containing about 0.05% max. manganese.

21. An age-hardenable, martensitic steel alloy which provides high strength and high fracture toughness, said alloy consisting essentially of, in weight percent, about

| | wt. % |
|---|---|
| Carbon | 0.21–0.27 |
| Manganese | 0.1 max. |
| Silicon | 0.1 max. |
| Phosphorus | 0.008 max. |
| Sulfur | 0.004 max. |
| Chromium | 3 |
| Nickel | 11 |
| Molybdenum | 1.2 |
| Cobalt | 13.5 |

and the balance is essentially iron, said alloy being further characterized such that in the aged condition it provides tensile strength of at least 280 ksi and $K_{IC}$ fracture toughness of at least 100 ksi $\sqrt{in}$.

22. An alloy as set forth in claim 21 which contains about 0.24% carbon.

23. An article having high strength and high fracture toughness, said article being formed of an age-hardenable, martensitic steel alloy consisting essentially of, in weight percent, about

| | wt. % |
|---|---|
| Carbon | 0.2–0.33 |
| Chromium | 2–4 |
| Nickel | 10.5–15 |
| Molybdenum | 0.75–1.75 |
| Cobalt | 8–17 |

and the balance essentially iron.

24. An article as set forth in claim 23 wherein the alloy contains at least about 0.21% carbon.

25. An article as set forth in claim 23 wherein the alloy contains at least about 10.75% nickel.

26. An article as set forth in claim 23 wherein a) $\%Co \leqq 35-81.1(\%C)$.

27. An article as set forth in claim 26 wherein b) $\%Co \geqq 25.5-70(\%C)$.

28. An article as set forth in claim 27 wherein when $\%Mo > 1.3$, %C is not more than the median %C for a given %Co as defined by relationships a) and b).

29. An article as set forth in claim 23 wherein the alloy contains not more than about 0.05% manganese.

* * * * *